US006152013A

United States Patent [19]

Shinohara et al.

[11] Patent Number: 6,152,013

[45] Date of Patent: Nov. 28, 2000

[54] HYDRAULICALLY ACTUATED BREAKER WITH LOST-MOTION PREVENTION DEVICE

[75] Inventors: Shigeru Shinohara; Mitsuru Arai; Takayuki Muto; Naoki Ishizaki, all of Tochigi-ken, Japan

[73] Assignee: Komatsu Ltd., Tokyo, Japan

[21] Appl. No.: 09/194,946

[22] PCT Filed: Jul. 24, 1997

[86] PCT No.: PCT/JP97/02577

§ 371 Date: Dec. 7, 1998

§ 102(e) Date: Dec. 7, 1998

[87] PCT Pub. No.: WO98/04387

PCT Pub. Date: Feb. 5, 1998

[30] Foreign Application Priority Data

Jul. 25, 1996 [JP] Japan ..... 8-195916

[51] Int. Cl.[7] ..... F01L 25/02; F01B 7/18

[52] U.S. Cl. ..... 91/300; 91/281; 91/321

[58] Field of Search ..... 91/281, 290, 293, 91/300, 321

[56] References Cited

U.S. PATENT DOCUMENTS

| | | | |
|---|---|---|---|
| 1,430,764 | 10/1922 | Smith | 91/321 X |
| 3,007,454 | 11/1961 | Joelson | 91/321 |
| 3,552,269 | 1/1971 | Arndt | 91/321 X |
| 3,713,367 | 1/1973 | Butterworth | 91/321 X |
| 3,774,502 | 11/1973 | Arndt | 91/321 X |
| 4,142,447 | 3/1979 | Krasnoff et al. | 91/321 X |
| 4,230,019 | 10/1980 | Castan | 91/321 X |
| 4,425,835 | 1/1984 | Krasnoff | 91/321 X |
| 4,444,274 | 4/1984 | Suwabe | 91/321 X |
| 4,646,854 | 3/1987 | Arndt et al. | 173/134 |
| 4,784,228 | 11/1988 | Ito | 91/321 X |
| 4,800,797 | 1/1989 | Comarmond | 91/321 X |
| 5,174,387 | 12/1992 | Arndt et al. | 91/321 X |
| 5,884,713 | 3/1999 | Shinohara et al. | 91/300 X |

FOREIGN PATENT DOCUMENTS

| | | |
|---|---|---|
| 53-101001 | 1/1952 | Japan . |
| 54-111878 | 8/1976 | Japan . |
| 55-17791 | 2/1980 | Japan . |
| 59-23953 | 6/1984 | Japan . |

*Primary Examiner*—John E. Ryznic

*Attorney, Agent, or Firm*—Wenderoth, Lind & Ponack, L.L.P.

[57] ABSTRACT

A hydraulically actuated breaker with a lost-motion preventing device includes a cylinder portion (26) defining a first chamber (23) constantly communicated with a hydraulic pressure source (47) and having a small pressure receiving area for upwardly moving a piston (22) and a second chamber (24) having a large pressure receiving area for downwardly moving the piston, by inserting the piston into a piston bore (21) of a breaker main body (20); a chisel (28) inserted within a chisel insertion hole (27) of the breaker main body in opposition to the piston; a main switching valve (40) being switched between a first position (E) communicating the second chamber with a tank (48) and a second position (F) communicating the second chamber with the hydraulic pressure source; and a valve mechanism (30) placing the main switching valve at the first position when the piston is in an effective lower stroke end position, placing the main switching valve at the second position when the piston is in an effective upper stroke end position, and maintaining the main switching valve at the second position when the piston is lowered beyond the effective lower stroke end position.

7 Claims, 6 Drawing Sheets

HYDRAULICALLY ACTUATED BREAKER WITH LOST-MOTION PREVENTION DEVICE

TECHNICAL FIELD

The present invention relates to a hydraulically actuated breaker with a lost-motion preventing device, which is mounted on an arm of a hydraulic shovel for the purpose of crushing concrete and so forth.

BACKGROUND ART

As shown in FIG. 1, for example, as a hydraulically actuated breaker, there has been known one, in which a cylinder portion 6 is constructed by inserting a piston 3 within a cylinder bore 2 of a breaker main body 1 and thus defining a first chamber 4 and a second chamber 5 at opposite sides, a chisel 8 is inserted into a chisel insertion hole 7 of the breaker main body 1, and a supply of a pressurized fluid to the first chamber 4 and the second chamber 5 is controlled to drive the piston 3 upwardly and downwardly to hammer the chisel 8.

For performing a crushing operation by mounting the above-mentioned hydraulically actuated breaker on a hydraulic shovel, as shown in FIG. 1, the breaker main body 1 is mounted on an arm 10 of the hydraulic shovel 9. A boom 13 and the arm 10 are pivoted downwardly to slightly lift a crawler 11 to apply a downward force to the breaker main body 1. In this condition, the piston 3 is driven reciprocally to hammer the chisel 8 to crush concrete 12. When the concrete 12 is crushed, the arm 10, the boom 13 and the crawler 11 are dropped together with the breaker. Then, the operator terminates the operation of the breaker, and shifts an objective position of impact by the chisel 8 by performing pivoting of the hydraulic shovel 9 or so forth in a condition where the boom 13 and the arm 10 are pivoted upwardly, to again actuate the breaker in this condition.

As set forth above, upon performing the crushing operation, if the operator cannot visually detect the fact that a crack is formed in the concrete 12 and thus it is crushed, and the operation of the breaker is continued, a penetration resistance to the chisel 8 becomes so significantly small that the chisel 8 is hammered into the crack to perform only hammering of the chisel 8 without acting the penetration resistance also acting on the chisel 8.

On the other hand, when the tip end of the chisel 8 continues to penetrate the concrete during the crushing thereof, the crawler which has been lifted, contacts with the ground surface. Subsequently, the penetration resistance does not act on the chisel 8 to perform only hammering of the chisel 8.

As set forth above, when only hammering of the chisel 8 is performed without the penetration resistance acting on the chisel, the piston 3 does not hammer the chisel 8 but hammers the breaker main body 1 (hereinafter referred to as "a lost motion"). Thus, the breaker main body 1 may be damaged. Also, the breaker is actuated wastefully to degrade an efficiency of the crushing operation.

The foregoing lost-motion will be discussed concretely. Normally, since the breaker main body 1 is pushed downwardly by a force in a direction shown by an arrow a, the chisel 8 is pushed onto the piston 3 by a penetration resistance in a direction shown by an arrow b to move a hammering position of the chisel by the piston 3 to a position c. Thus, the piston 3 hammers the chisel 8. However, when a crack is formed in the concrete 12 and thus the penetration resistance to the chisel 8 becomes significantly small, the piston 3 is lowered down to a stroke end d to hammer the breaker main body 1 without hammering the chisel 8.

As a structure for preventing the foregoing lost motion, there has been known a first construction, in which a pressurized fluid filled damping chamber for braking the piston when the piston is lowered beyond a predetermined stroke, is provided to stop the piston by the pressurized fluid filled damping chamber or to prevent a collision with the breaker main body.

On the other hand, as disclosed in Japanese Unexamined Utility Model Publication No. Showa 53-101001, there has been known a second structure, in which a hydraulically actuated switching valve actuated with a pressure of the cylinder applying a force to the breaker as a pilot pressure, is provided to make the breaker inoperative by switching the hydraulically actuated switching valve when no pressure is applied to the cylinder.

Also, as disclosed in Japanese Unexamined Utility Model Publication No. Showa 55-17791, there has been known a third structure, in which a supply opening and a discharge opening for supplying and discharging a pressurized fluid to a first chamber and from a second chamber of a cylinder portion, respectively, are communicated when the piston is lowered beyond a predetermined stroke to stop the piston.

However, in the foregoing first structure, it becomes necessary to set a damper clearance of the pressurized fluid filled damping chamber at a predetermined value and a strength of the breaker main body to be required for preventing damage of the breaker main body accompanying an elevating of pressure of the filled pressurized fluid becomes large thus making production costs high.

Furthermore, the pressurized fluid filled damping chamber is adapted to slow-down a speed of the piston and not to stop the piston. Therefore, the piston is sequentially actuated for reciprocation. If the piston is moved beyond the pressurized fluid filled damping chamber, the piston collides and hammers the breaker main body repeatedly to damage the breaker main body.

In the foregoing second structure, since the hydraulically actuated switching valve which is not used in a normal operation of the breaker, is provided and a pressure of the cylinder applying a pushing force to the breaker is detected to cause the pressure to act on the hydraulically actuated switching valve as the pilot pressure. Thus, the structure is complicated thereby making the hydraulic piping complicated.

In the foregoing third structure, since a bypass passage is formed in the cylinder portion or a cut-out is formed in the piston, machining of the cylinder portion becomes quite troublesome. Also, a leakage amount of the fluid becomes large.

Therefore, it is an object of the present invention to provide a hydraulically actuated breaker with a lost motion preventing device which can solve the foregoing problem.

DISCLOSURE OF THE INVENTION

In order to accomplish the above-mentioned object, one aspect of the hydraulically actuated breaker with a lost-motion preventing device according to the present invention comprises:

a breaker main body having a piston bore and a chisel insertion hole, and comprising a cylinder portion formed by a piston disposed in said piston bore to define a first chamber constantly communicated with a hydraulic pressure source and having a small pressure receiving area for upwardly moving a piston and a second chamber having a large pressure receiving area for downwardly moving the piston;

a chisel inserted within the chisel insertion hole of the breaker main body in opposition to the piston;

a main switching valve being switched between a first position communicating the second chamber with a tank and a second position communicating the second chamber with the hydraulic pressure source; and a valve mechanism placing the main switching valve at the first position when the piston is in an effective lower stroke end position, placing the main switching valve at the second position when the piston is in an effective upper stroke end position, and maintaining the main switching valve at the second position when the piston is lowered beyond the effective lower stroke end position.

With this construction, when the piston is lowered beyond the effective lower stroke end position, the main switching valve is maintained at the second position and thus the piston stops its reciprocal operation.

By this, when the breaker is in a lost-motion state, the breaker is automatically stopped to prevent the piston from hammering the breaker main body many times to damage it. Furthermore, upon performing a crushing operation, mounting the device on an arm of a hydraulic shovel, since the operator may perceive the lost-motion state, the crushing operation can be performed efficiently.

In addition, since the device has a function for stopping the piston in the lost-motion state, provided in the valve mechanism which is a component of the usual hydraulically actuated breaker, a special switching valve and so forth is unnecessary thereby making the structure simple.

In addition to the construction set forth above, the cylinder portion may be formed with a pressurized fluid filled damping chamber for slowing down a speed of the piston when the piston is lowered beyond the effective lower stroke end position.

With this construction, since the speed of the piston is slowed down by the pressurized fluid filled damping chamber when the piston is lowered beyond the effective lower stroke end, the piston may stop moderately. By this, a shock upon stopping can be reduced.

In the construction set forth above, the valve mechanism preferably comprises fluid passages such as a drill hole, an annular groove and a slit and so forth which are formed in the piston bore and the piston.

With this construction, machining of the valve mechanism becomes simple. Also, since a large amount of fluid will not flow through the drill hole, the annular groove, the slit and so forth, leakage of the fluid can be reduced.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

BEST MODE FOR IMPLEMENTING THE INVENTION

At first, the first embodiment of the hydraulically actuated breaker with the lost motion preventing device according to the present invention will be discussed.

Figure 1:
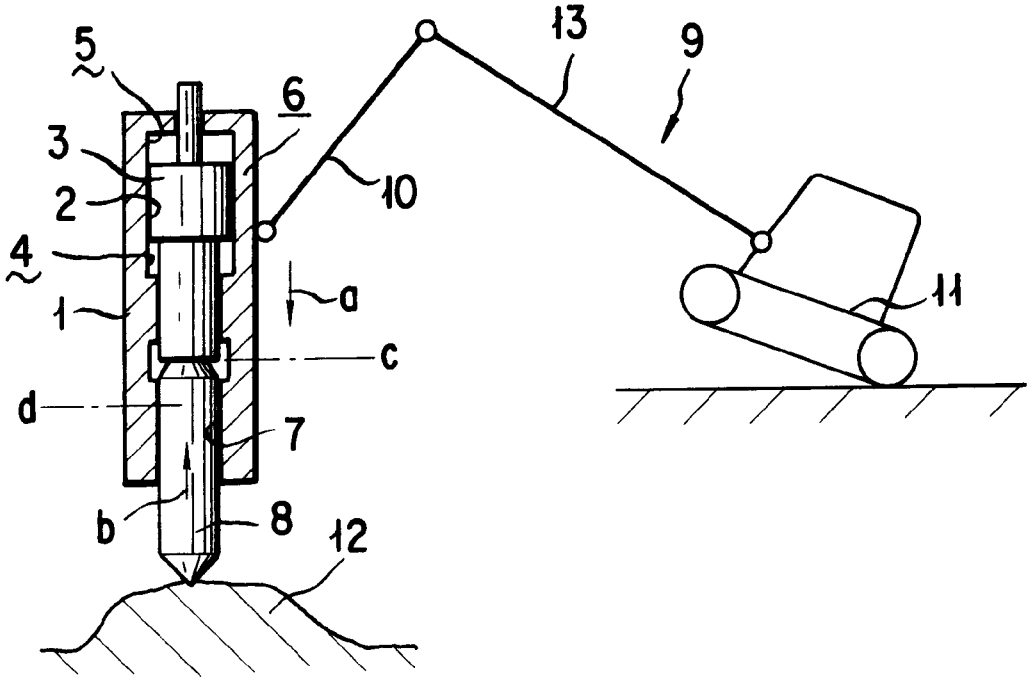
FIG. 1 is an explanatory illustration of a conventional hydraulically actuated breaker.
Figure 2:
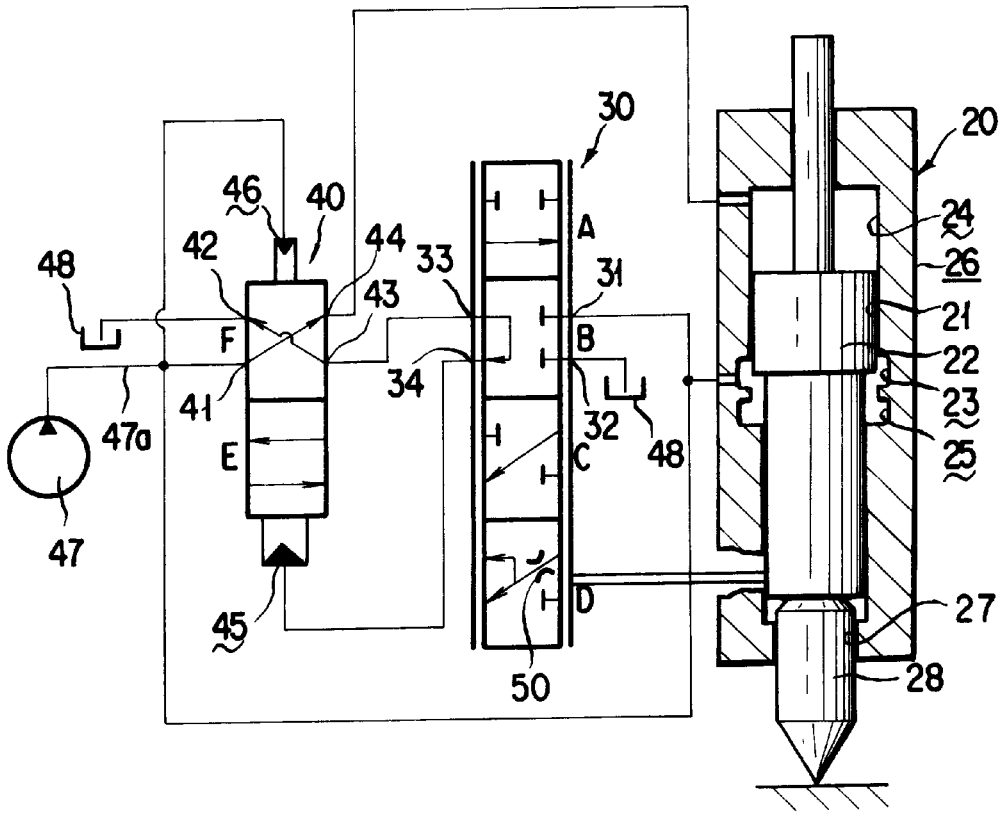
FIG. 2 is an explanatory illustration of a diagrammatic construction showing a first embodiment of a hydraulically actuated breaker with a lost motion preventing device according to the present invention.

As shown in FIG. 2, a cylinder portion 26 is constructed by inserting a piston 22 into a piston bore 21 of a breaker main body 20 and thus defining a first chamber 23, a second chamber 24 and a pressurized fluid filled damping chamber 25. Then, a chisel 28 is slidably inserted into a chisel insertion hole 27 of the breaker main body 20.

A valve mechanism 30 has a first port 31, a second port 32, a third port 33 and a fourth port 34 and is actuated to switch between a first position A, a second position B, a third position C and a fourth position D cooperating with a movement of the piston 22.

A main switching valve 40 has a pump port 41, a tank port 42, a third port 43 and a fourth port 44 and has a first pressure receiving portion 45 having a large pressure receiving area and a second pressure receiving portion 46 having a small pressure receiving area. The main switching valve 40 is moved to a first position E with a pressure applied to the first pressure receiving portion 45 and to a second position F with a pressure applied to the second pressure receiving portion 46.

A discharge passage 47*a* of a hydraulic pump 47 communicates with the first chamber 23, the first port 31, the pump port 41 and the second pressure receiving portion 46; the second port 32 and the tank port 42 communicate with a tank 48; the third port 33 communicates with the third port 43; the fourth port 34 communicates with the first pressure receiving portion 45, and the fourth port 44 communicates with the second chamber 24.

Next, an operation of the shown illustrated embodiment will be discussed.

In the condition shown in FIG. 2, the main switching valve 40 is in the second position F and the pressurized fluid is supplied to the second chamber 24, and in conjunction therewith, the pressurized fluid is supplied to the first chamber 23. The piston 22 is then lowered, namely moved in a working direction, with a pressure receiving area difference x hydraulic pressure.

When the piston 22 is lowered down to an effective lowering stroke end for hammering the chisel 28, the valve mechanism 30 is moved to the third position C. Therefore, the discharged pressurized fluid of the hydraulic pump 47 acts on the first pressure receiving portion 45 through the first port 31 and the fourth port 34. Then, the main switching valve 40 is moved to the first position E. Thus, the second chamber 24 is communicated with the tank 48 to cause flow of the discharged pressurized fluid of the hydraulic pump 47 into the first chamber 23 to drive the piston 22 upwardly, namely to move in a return direction. When the piston 22 reaches an upward stroke end position, since the valve mechanism 30 is moved to the first position A, the first pressure receiving portion 45 is communicated with the tank 48. As set forth above, the main switching valve 40 is moved to the second position F.

By repeating the foregoing operation, the piston 22 is driven upwardly and downwardly within a range of effective stroke to hammer the chisel 28 for performing a crushing operation.

After the crushing is completed in the foregoing condition, when the chisel 28 is placed in a lost motion state, the piston 22 is lowered beyond the effective lowering stroke end position to project into the pressurized fluid filled damping chamber 25 to be decelerated. In conjunction therewith, the valve mechanism 30 is moved to the fourth position D.

When the valve mechanism 30 is in the fourth position D, the first port 31 is communicated with the third port 33 and the fourth port 34 via a restriction 50. The third port 33 is communicated with the tank 48 via the first port 43 and the tank port 42 of the main switching valve 40.

By this, the discharged pressurized fluid of the hydraulic pump 47 flows out to the tank 48 via the restriction 50 and the first pressure receiving portion 45 is communicated with the tank 48, and thus the main switching valve 40 is held in the second position F. The pressurized fluid having a low pressure corresponding to a resistance of the restriction 50 flows into the second chamber 24.

Accordingly, the piston 22 is lowered with a small force to be placed at a stopped state by a filled pressure within the pressurized fluid filled damping chamber 25. Thus, the operation of the breaker is stopped.

In order to resume the operation of the breaker, the chisel 28 is moved by a pivot motion of the hydraulic shovel to be pressed onto a non-crushed position. By this, the piston 22 is relatively moved upwardly to move the valve mechanism 30 to the third position C.

Next, a particular structure of the shown illustrated embodiment will be discussed with reference to FIG. 3.

It should be noted that like members and portions of the diagrammatic embodiment will be identified by like reference numerals and a discussion therefor will be omitted.

A drill hole 51 is formed in the piston 22. At the periphery of the piston bore 21, first, second, and third annular grooves 52, 53 and 54 are formed. The second annular groove 53 serves as the third port 33 and the first and third annular grooves 52 and 54 serve as the fourth port 34. In the piston 22, a first slit 55, a second slit 56 and a third slit 57 are formed. The opening at one end of the drill hole 51 to the first slit 55, serves as the first port 31. Then, the other end of the drill hole 51 is open to the first chamber 23. In the breaker body 20, a drain hole 58 opening to the piston bore 21 at one end thereof is formed, and an opening thereof to the side of the second and third slits 56 and 57 serves as the second port 32. These form the valve mechanism 30.

By inserting a spool 60 into the spool bore 59 of the breaker main body 20, the main switching valve 40 is constructed.

Figure 3:
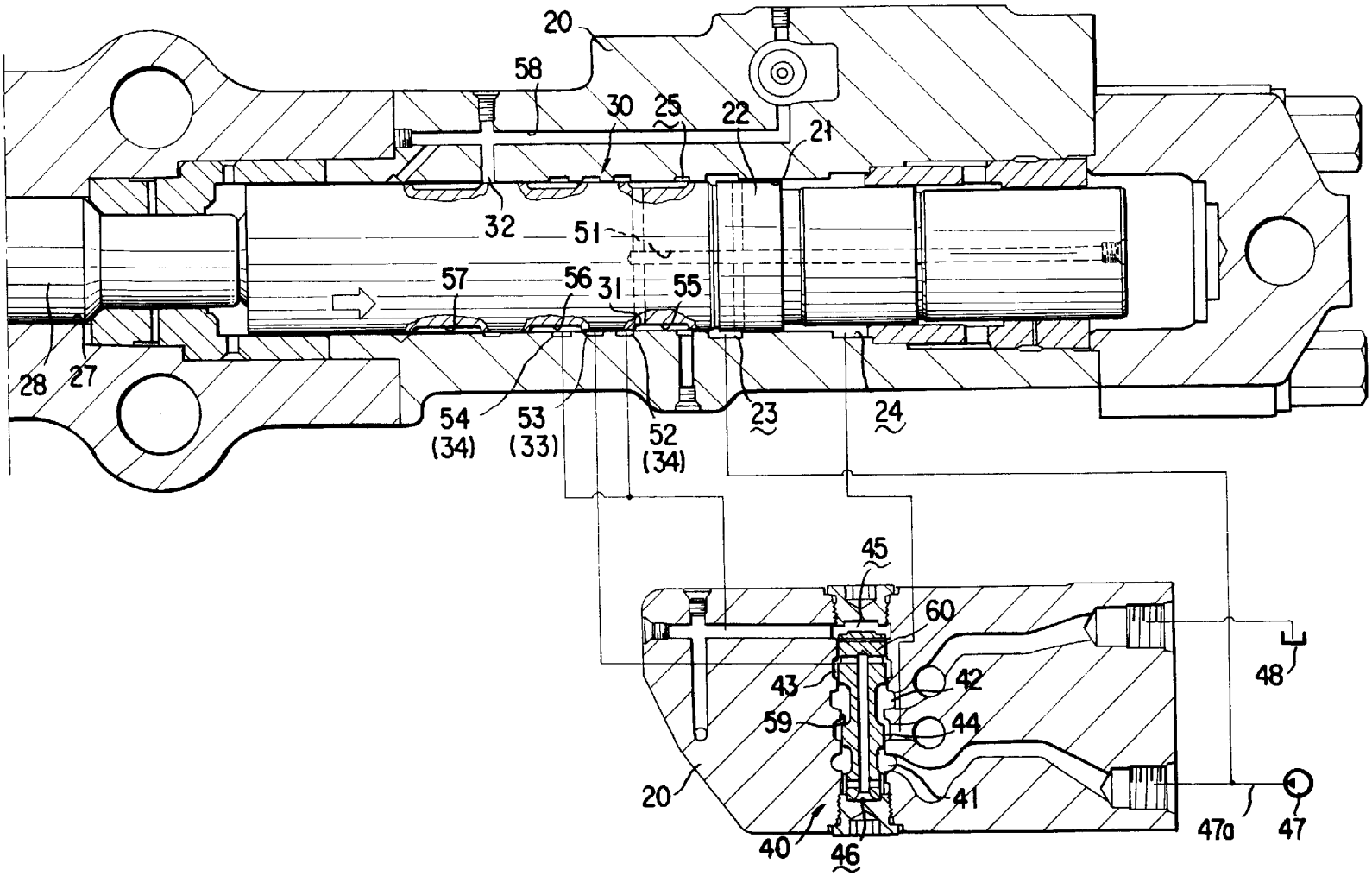
FIG. 3 is a section showing a normal hammering state of a concrete construction of the first embodiment set forth above.

In FIG. 3, since the piston 22 is positioned at the effective lower stroke end position and the valve mechanism 30 is in the third position C to communicate the first port 31 with the first annular groove 52 (34) via the first slit 55, the discharged pressurized fluid of the hydraulic pump 47 flows into the first pressure receiving portion 45 of the main switching valve 40 to move the spool 60 to shift the main switching valve 40 to the first position E to communicate the second chamber 24 with the tank port 42 through the second port 44.

By this, the piston 22 is elevated by the pressurized fluid within the first chamber 23. When the piston 22 reaches the upper stroke end position, the valve mechanism 30 is moved to the first position A to establish communication between the third annular groove 54 (34) and the second port 32 via the third slit 57, and the first pressure receiving portion 45 of the main switching valve 40 is communicated with the tank 48. Thus, the spool 60 is pushed by the pressurized fluid of the second pressure receiving portion 46 to shift the main switching valve 40 to the second position F. Then, the pressurized fluid of the hydraulic pump 47 is supplied to the first chamber 23 and the second chamber 24 to lower the piston 22 with the pressure receiving area difference between the first chamber 23 and the second chamber 24 x fluid pressure.

Figure 4:
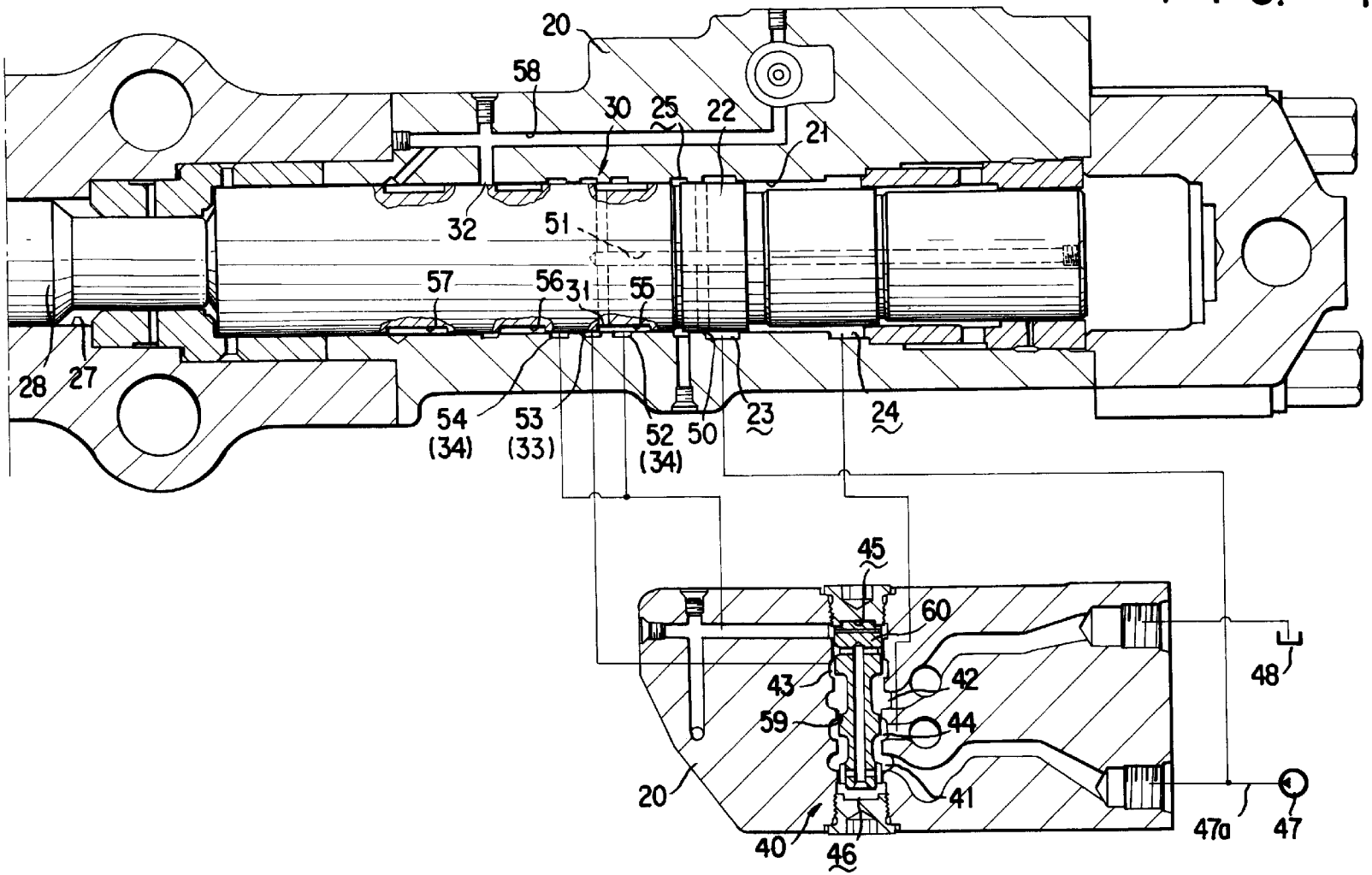
FIG. 4 is a section showing a lost motion state of the concrete construction of the first embodiment set forth above.

FIG. 4 shows a state where the piston 22 is lowered beyond the effective lower stroke end position. The valve mechanism 30 is then in the fourth position D to communicate the first annular groove 52 (34) and the second annular groove 53 (33) with the first port 31 via the first slit 55, and the second annular groove 53 (33) is communicated with the tank port 42 through the first port 43 of the main switching valve 40. At this time, the first annular groove 52 (34) and the second annular groove 53 (33) are communicated with the first chamber 23 via the drill hole 51. However, in this state, the opening area between the drill hole 51 and the first chamber 23 becomes smaller to act as the restriction 50.

By this, the pump pressure acts on the second pressure receiving portion 46 of the main switching valve 40, and the hydraulic pressure of the first pressure receiving portion 45 becomes a tank pressure. Therefore, the main switching valve 40 is held at the second position F. Thus, as set forth above, the reciprocal operation of the piston 22 is stopped.

Next, the second embodiment of the present invention will be discussed.

Figure 5:
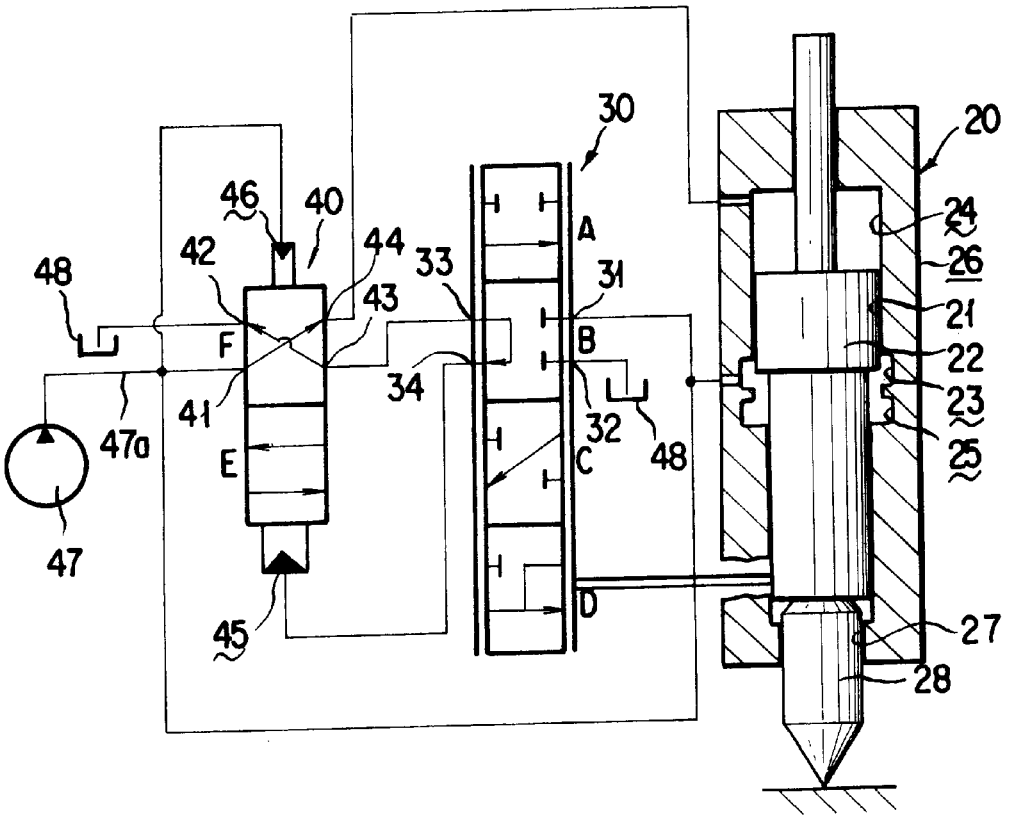
FIG. 5 is an explanatory illustration of a diagrammatic construction showing a second embodiment of the hydraulically actuated breaker with a lost motion preventing device according to the present invention.

As shown in FIG. 5, when the valve mechanism 30 is in the fourth position D, the first port 31 and the fourth port 34 are communicated with the tank 48 through the second port 32.

Thus, when the piston 22 is lowered beyond the effective lower stroke end position to move the valve mechanism 30 to the fourth position D, the discharged pressurized fluid of the hydraulic pump 47 flows out to the tank 48. Thus, the main switching valve 40 is maintained at the second position F. Then, the piston 22 stops its reciprocal motion as set forth above.

Figure 6:
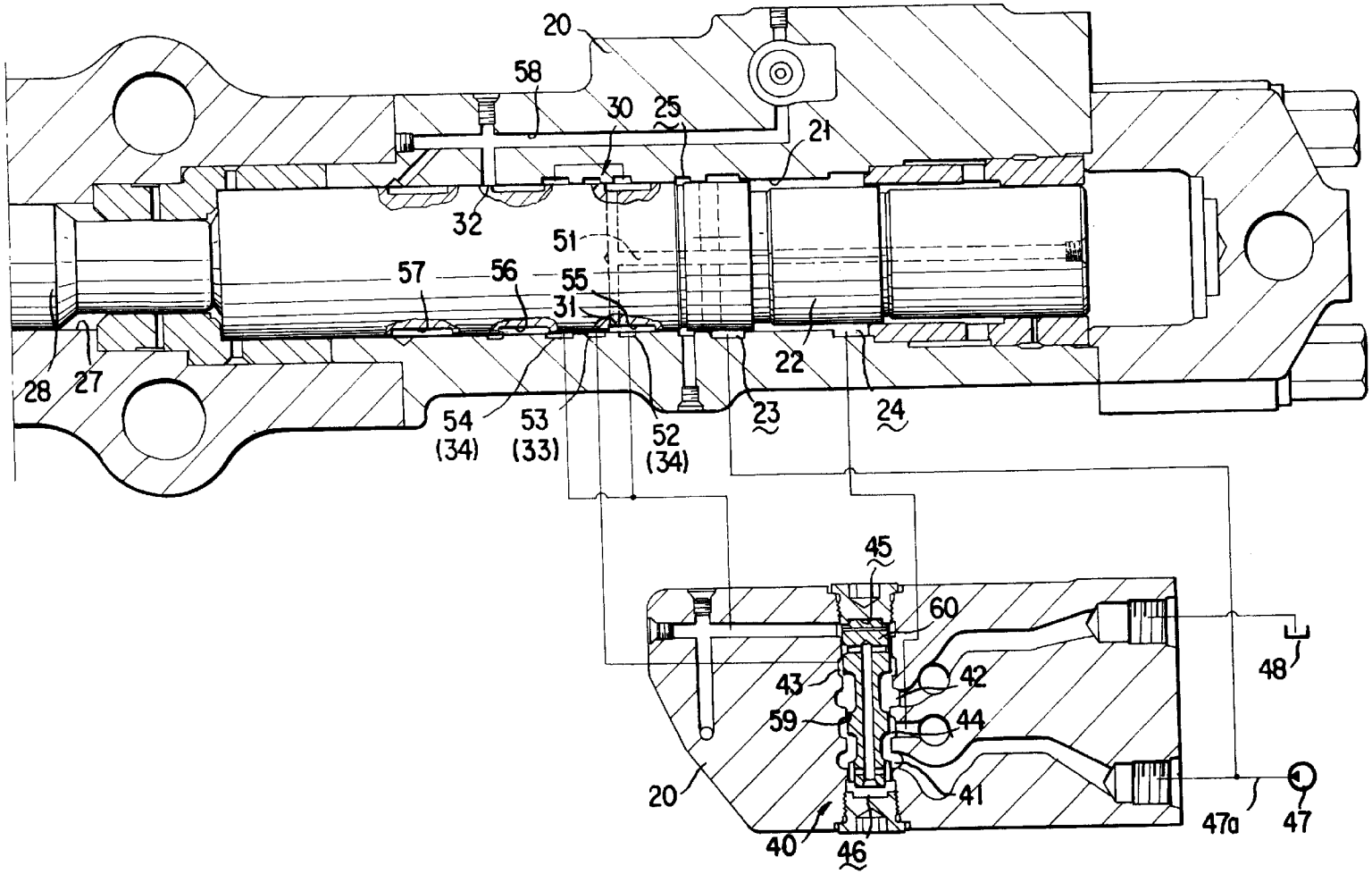
FIG. 6 is a section of a concrete structure in a lost motion state of the second embodiment set forth above.

In this case, the particular construction is substantially the same as the first embodiment in the basic construction. However, as shown in FIG. 6, lengths of the first slit 55 and the second slit 56 in an axial direction of the piston 22 are respectively set in a length not establishing communication between the first annular groove 52(34) and the second annular groove 53(33) and a length establishing communication between the third annular groove 54 and the second port 32 when the piston 22 is lowered beyond the effective lower stroke end position. In addition, the opening area between the drill hole 51 and the first chamber 23 is made large.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be embodied within a scope encompassed and equivalents thereof with respect to the features set out in the appended claims.

What is claimed is:

1. A hydraulically actuated breaker with a lost-motion preventing device, comprising:

a breaker main body having a piston bore and a chisel insertion hole, and comprising a cylinder portion formed by a piston disposed in said piston bore to define a first chamber constantly communicated with a hydraulic pressure source and having a small pressure receiving area for upwardly moving said piston and a second chamber having a large pressure receiving area for downwardly moving said piston;

a chisel inserted within said chisel insertion hole of said breaker main body in opposition to said piston;

a main switching valve switchable between a first position communicating said second chamber with a tank and a second position communicating said second chamber with the hydraulic pressure source; and a valve mechanism for placing said main switching valve at said first position when said piston is in an effective lower stroke end position, placing said main switching valve at said second position when said piston is in an effective upper stroke end position, and maintaining said main switching valve at said second position when said piston is lowered beyond said effective lower stroke end position;

wherein said main switching valve comprises a first pressure receiving portion for placing said main switching valve at said first position and a second pressure receiving portion for placing said main switching valve at said second position, and when said piston is lowered beyond said effective lower stroke end position, said valve mechanism communicates said first chamber and said first pressure receiving portion with said tank.

2. A hydraulically actuated breaker with a lost-motion preventing device, as set forth in claim 1, wherein said cylinder portion is formed with a pressurized fluid filled damping chamber for slowing down a speed of said piston when said piston is lowered beyond said effective lower stroke end position.

3. A hydraulically actuated breaker with a lost-motion preventing device, as set forth in claim 2, wherein said valve mechanism comprises fluid passages which are formed in said piston bore and said piston.

4. A hydraulically actuated breaker with a lost-motion preventing device as set forth in claim 1, wherein said valve mechanism comprises fluid passages which are formed in said piston bore and said piston.

5. A hydraulically actuated breaker with a lost-motion preventing device, as set forth in claim 1, wherein when said piston is lowered beyond said effective lower stroke end position, a restriction is formed between said first chamber and said tank.

6. A hydraulically actuated breaker with a lost-motion preventing device, comprising:

a breaker main body having a piston bore and a chisel insertion hole, and comprising a cylinder portion formed by a piston disposed in said piston bore to define a first chamber constantly communicated with a hydraulic pressure source and having a small pressure receiving area for upwardly moving said piston and a second chamber having a large pressure receiving area for downwardly moving said piston;

a chisel inserted within said chisel insertion hole of said breaker main body in opposition to said piston;

a main switching valve switchable between a first position communicating said second chamber with a tank and a second position communicating said second chamber with the hydraulic pressure source; and a valve mechanism for placing said main switching valve at said first position when said piston is in an effective lower stroke end position, placing said main switching valve at said second position when said piston is in an effective upper stroke end position, and maintaining said main switching valve at said second position when said piston is lowered beyond said effective lower stroke end position;

wherein when said piston is lowered beyond said effective lower stroke end position, a restriction is formed between said first chamber and said tank.

7. A hydraulically actuated breaker with a lost-motion preventing device, as set forth in claim 6, wherein said valve mechanism comprises fluid passages which are formed in said piston bore and said piston.

* * * * *